United States Patent [19]

Cha et al.

[11] 4,076,312

[45] Feb. 28, 1978

[54] METHOD AND APPARATUS FOR RETORTING OIL SHALE AT SUBATMOSPHERIC PRESSURE

[75] Inventors: Chang Yul Cha, Bakersfield, Calif.; Richard D. Ridley; Robert S. Burton, III, both of Grand Junction, Colo.

[73] Assignee: Occidental Oil Shale, Inc., Grand Junction, Colo.

[21] Appl. No.: 710,108

[22] Filed: Jul. 30, 1976

Related U.S. Application Data

[63] Continuation-in-part of Ser. No. 492,823, Jul. 29, 1974, abandoned.

[51] Int. Cl.[2] ..... E21B 43/18; E21B 43/24; E21B 43/26; E21C 41/10

[52] U.S. Cl. ..... 299/2; 166/259; 299/12

[58] Field of Search ..... 166/251, 256, 259–262, 166/272; 299/2, 12

[56] References Cited

U.S. PATENT DOCUMENTS

| | | | |
|---|---|---|---|
| 947,008 | 1/1910 | Betts | 299/2 |
| 1,269,747 | 6/1918 | Rogers | 299/2 |
| 1,867,758 | 7/1932 | Ranney | 299/2 |
| 2,481,051 | 9/1949 | Uren | 299/2 |
| 2,630,306 | 3/1953 | Evans | 299/2 |
| 2,801,089 | 7/1957 | Scott, Jr. | 299/2 |
| 2,841,375 | 7/1958 | Salomonsson | 166/256 X |
| 2,853,137 | 9/1958 | Marx et al. | 166/259 X |
| 2,911,206 | 11/1959 | Purre | 166/272 X |
| 3,661,423 | 5/1972 | Garret | 299/2 |
| 3,692,110 | 9/1972 | Grady | 166/259 X |

FOREIGN PATENT DOCUMENTS

| | | | |
|---|---|---|---|
| 812,573 | 9/1951 | Germany | 299/2 |

*Primary Examiner*—Stephen J. Novosad
*Assistant Examiner*—George A. Suchfield
*Attorney, Agent, or Firm*—Christie, Parker & Hale

[57] ABSTRACT

In a process for retorting oil shale in an situ oil shale retort having a tunnel adjacent the retort, off gas is produced. Leakage of the off gas into the tunnel is prevented by withdrawing off gas from the retort at a rate sufficient to reduce the pressure in the retort adjacent the tunnel to a pressure below the ambient pressure within the tunnel.

16 Claims, 1 Drawing Figure

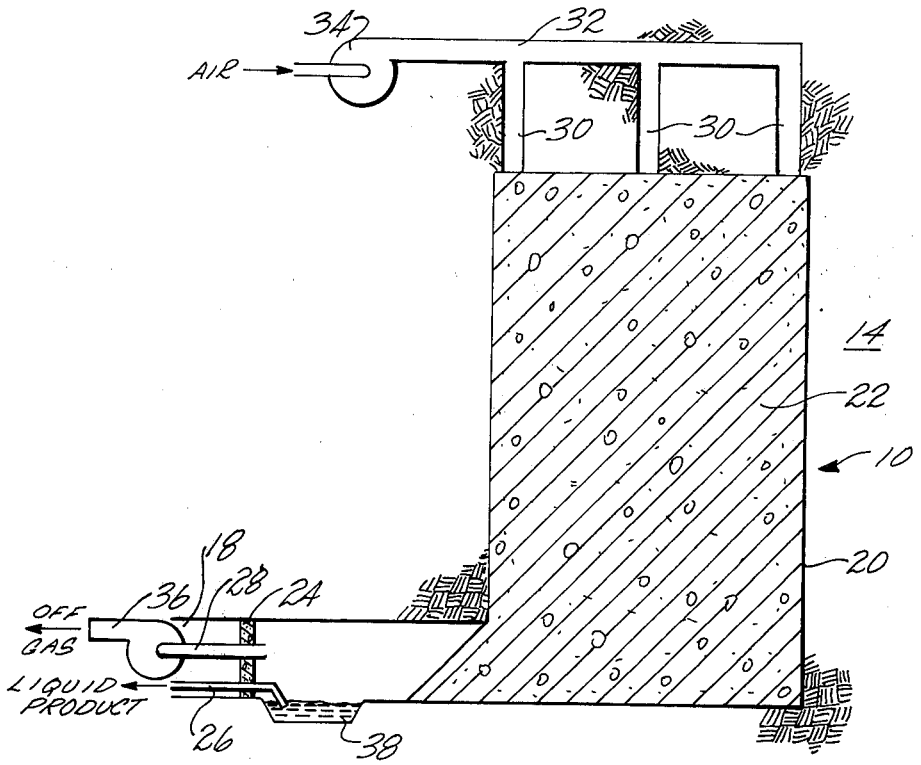
34
32
AIR
30
30
14
22
10
20
18
36
28
24
OFF GAS
LIQUID PRODUCT
26
38

METHOD AND APPARATUS FOR RETORTING OIL SHALE AT SUBATMOSPHERIC PRESSURE

CROSS-REFERENCES

This application is a continuation-in-part of U.S. patent application Ser. No. 492,823, now abandoned filed July 29, 1974, and assigned to the assignee of this application.

BACKGROUND OF THE INVENTION

The presence of large deposits of oil shale in the Rocky Mountain region of the United States has given rise to extensive efforts to develop methods of recovering shale oil from kerogen in the oil shale deposits. It should be noted that the term "oil shale" as used in the industry is in fact a misnomer; it is neither shale nor does it contain oil. It is a sedimentary formation comprising marlstone deposit interspersed with layers containing an organic polymer called "kerogen", which upon heating decomposes to produce carbonaceous liquid and gaseous products. It is the formation containing kerogen that is called "oil shale" herein, and the liquid carbonaceous product is called "shale oil".

A number of methods have been developed for processing the oil shale which involve either first mining the kerogen bearing shale and processing the shale above ground, or processing the shale in situ. The latter approach is preferable from the standpoint of environmental impact since the spent shale remains in place, reducing the chance of surface contamination and the requirement for disposal of solid wastes.

The recovery of liquid and gaseous products from oil shale deposits has been described in several patents, one of which is U.S. Pat. No. 3,661,423, issued May 9, 1972 to Donald E. Garrett, assigned to the assignee of this application, and incorporated herein by reference. This patent describes in situ recovery of liquid and gaseous carbonaceous materials from a subterranean oil shale deposit by mining out a portion of shale in a subterranean oil shale deposit and then fragmenting and expanding a portion of the remaining oil shale in the deposit to form a stationary body of fragmented oil shale within the deposit, referred to herein as an in situ oil shale retort. Hot retorting gases are passed through the in situ oil shale retort to convert kerogen contained in the oil shale to liquid and gaseous products.

One method of supplying hot retorting gases used for converting kerogen contained in the oil shale, as described in U.S. Pat. No. 3,661,423, includes establishment of a combustion zone in the retort and introduction of an oxygen supplying gaseous feed mixture downwardly into the combustion zone to advance the combustion zone downwardly through the retort. In the combustion zone oxygen in the gaseous feed mixture is depleted by reaction with hot carbonaceous materials to produce heat and combustion gas. By the continued introduction of the oxygen supplying gaseous feed mixture downwardly into the combustion zone, the combustion zone is advanced downwardly through the retort.

The effluent gas from the combustion zone comprises combustion gas and the portion of the gaseous feed mixture which does not take part in the combustion process. This effluent gas is essentially free of free oxygen and contains constituents such as oxides of carbon and sulfurous compounds. It passes through the retort on the advancing side of the combustion zone to heat the oil shale in a retorting zone to a temperature sufficient to produce kerogen decomposition, called retorting, in the oil shale to gaseous and liquid products and a residue product of solid carbonaceous material.

The liquid products and gaseous products are cooled by the cooler oil shale fragments in the retort on the advancing side of the retorting zone. The liquid carbonaceous products, together with water produced in or added to the retort, are collected at the bottom of the retort and withdrawn to the surface through an access tunnel, drift or shaft. An off gas containing combustion gas generated in the combustion zone, product gas produced in the retorting zone, gas from carbonate decomposition, and gaseous feed mixture which does not take part in the combustion process is also collected at the bottom of the retort and withdrawn to the surface. The off gas contains constituents such as hydrogen, carbon monoxide, carbon dioxide, hydrocarbons, and hydrogen sulfide.

In introducing oxygen supplying gas into the retort, the pressure within the retort can rise to a level greater than the pressure in adjacent access tunnels in the formation. As a result, some leakage of gases from the retort can take place through cracks and faults in the formation into the tunnels. Since gases downstream of the combustion zone contain noxious sulfurous compounds and carbon monoxide which is poisonous, leakage of these gases from the retort can give rise to dangerous conditions in tunnels adjacent the retort.

Therefore, there is a need for a process and apparatus for retorting oil shale in situ which prevents leakage of gas from a retort into tunnels adjacent the retort.

SUMMARY OF THE INVENTION

The present invention is directed to a process and apparatus for preventing leakage of gases from an in situ oil shale retort to avoid dangers from such leakage. Specifically, the above described retorting process is carried out by withdrawing off gas from the fragmented mass in the in situ oil shale retort on the advancing side of the retorting zone at a rate sufficient to reduce pressure within the in situ oil shale retort on the advancing side of the combustion zone to less than the ambient pressure in tunnels adjacent the retort. Thus any leakage between the retort on the advancing side of the combustion zone and surrounding spaces is into the retort, thereby preventing leakage of gas from the retort on the advancing side of the combustion zone. Preferably off gas is withdrawn from the retort at a rate sufficient to reduce the pressure in all locations of the retort to less than the ambient pressure in tunnels adjacent the retort to prevent all leakage from the retort.

DRAWING

These and other features, aspects and advantages of the present invention will become more apparent with respect to the following description, appended claims and accompanying drawing which represents semi-schematically in vertical cross section an in situ oil shale retort incorporating features of this invention.

DESCRIPTION

Referring to the drawing, an in situ oil shale retort 10 is in the form of a cavity 20 formed in an unfragmented subterranean formation 14 containing oil shale. According to the shale oil recovery process described in the above-identified U.S. Pat. No. 3,661,424, the retort is formed by providing an access drift or tunnel 18 from the surface through the subterranean formation. The tunnel section 18 illustrated in the drawing may be a part of a tunneling system extending to a plurality of retorts such as the retort 10.

The access tunnel 18 is used while mining out a portion of the formation within the site of an in situ oil shale retort. After the mining operation, formation remaining within the retort site is fragmented and explosively expanded by explosive charges to form the cavity 20 containing a fragmented permeable mass 22 of formation particles containing oil shale. The tunnel 18 is then blocked off at the entrance to the cavity by suitable blocking means such as a concrete barrier or bulkhead 24 through which an outlet conduit 26 and a gas withdrawal pipe 28 extend. The conduit 26 is used to recover liquids from the retort, and the pipe 28 is used to withdraw off gas from the retort.

During the retorting operation of the retort 10, a combustion zone is established in the retort by igniting a portion of the fragmented mass. The combustion zone is advanced through the fragmented permeable mass by introducing a gaseous feed containing an oxygen supplying gas such as fresh air or air mixed with other gases into the in situ oil shale retort through inlet means communicating with the upper region of the retort such as a primary inlet conduit 32 in fluid communication with one or more secondary inlet conduits 30. The gaseous feed can be caused to flow into the retort by means such as a blower 34. As the gaseous feed flows through the fragmented mass in the retort, oxygen oxidizes carbonaceous material in the oil shale to produce combusted oil shale and combustion product gases.

An effluent gas from the combustion zone comprising combustion product gases produced in the combustion zone, any unreacted portion of the gaseous combustion zone feed, and gases from carbonate decomposition is passed through the fragmented mass of particles on the advancing side of the combustion zone. Heat carried by the effluent gas establishes a retorting zone on the advancing side of the combustion zone. As oil shale is retorted in the retorting zone, kerogen is converted to liquid and gaseous products.

Liquid products formed in the retorting zone collect in a sump 38 at the bottom of the tunnel 18 to be withdrawn through the conduit 26 for further processing. An off gas, which contains gaseous products, combustion product gases, gas from carbonate decomposition, and any unreacted portion of the gaseous combustion zone feed, passes from the retort on the advancing side of the retorting zone into the portion of the tunnel 18 inside the barrier 24 and is then withdrawn through the barrier 24 into the pipe 28 for further processing. The barrier seals the retort from the balance of the tunnel to prevent gas communication.

The blower 34, by forcing air under pressure into the retort, was heretofore relied on to force gas to flow downwardly through the retort and out through the pipe 28. It has been found however that the surrounding formation is not always completely impervious to the flow of gases out of the retort. As a result some of the combustion zone effluent gas and off gas can escape from the retort so that a part of these gases leak into drifts, shafts and other tunnels such as the access tunnel 18.

Since the access tunnel 18 can be part of a common network of tunnels, drifts, shafts and the like, used to mine and service other retorts within the same oil shale deposit, accumulation of product gases in this tunneling system presents a hazardous condition.

According to the present invention gas withdrawing or pumping means such as a blower or vacuum pump 36 are provided on the withdrawal pipe 28. The withdrawing means has sufficient capacity for reducing pressure within at least a portion of the retort adjacent the tunnel 18 to a pressure less than the ambient pressure in the tunnel 18 to prevent leakage from the retort into the tunnel.

Since gas on the advancing side of the combustion zone is substantially free of free oxygen, and contains poisonous carbon monoxide and noxious or toxic sulfurous compounds, leakage of gas on the advancing side of the combustion into tunnels adjacent the retort can present a serious problem. Therefore, preferably the withdrawing means has sufficient capacity to reduce the pressure within all of the retort on the advancing side of the combustion zone to less than the ambient pressure in tunnels adjacent the retort, such as the access tunnel 18, to prevent leakage of dangerous gases from the retort into such tunnels. It is within the contemplation of this invention to maintain a continuous flow of gas through the retort with the entire retort at or less than the ambient pressure in all tunnels adjacent the retort to prevent leakage from the retort. If desired, the entire retort can be maintained at sub-atmospheric pressure.

The present invention can be used with alternate approaches currently in use for forced ventilation of mine tunnel systems. In one approach, the mine tunnels are pressurized by forcing fresh air through some of the passages and permitting air to exhaust freely through others. With another technique, air is exhausted from one passage with entry of fresh air into other passages by natural circulation. In the first technique a pressurized mine results where the pressure within the workings is higher than ambient pressure at the altitude outside the mine. In the second system the pressure in the tunnels is less than external ambient pressure.

In practice of this invention, leakage of gases from the retorts into the mining tunnels is prevented with both of these ventilation approaches by maintaining pressure in the portion of the retort adjacent the tunnels at less than the adjacent ambient pressure in the tunnels. There is sufficient pumping capacity that the pressure in the retort is lower than that in the tunnels, and when the tunnels are at sub-ambient pressure, the pressure in the retort is lower than the ambient pressure outside the entire tunnel system.

According to one version of the present invention, the gas withdrawing means on the withdrawal pipe 28 is capable of reducing the pressure at the bottom of the retort to 2 or 3 pounds per square inch below the ambient pressure within the access tunnel 18, which is maintained at or above atmospheric pressure. At the same time, the blower 34 is operated such that the pressure at the top of the retort is at or slightly below or slightly above the atmospheric pressure. Thus the blower 34 is operated to overcome the normal pressure drop within the oxygen containing gas introduction system provided by the inlet conduits 32 and 30. In this way the blower 34 and pumping means 36 operate to provide a continuous flow of gases through the retort. This arrangement provides adequate oxygen containing gas to maintain combustion in the combustion zone while at the same time producing a flow of combustion gases through the retort and maintaining a pressure less than the ambient pressure in adjacent tunnels on at least the advancing side of the combustion zone. Thus any leakage of gas between the portion of the retort on the advancing side of the combustion zone and the tunnel 18 or other adjacent tunnels results in flow into the retort rather than out of the retort. In this manner, leakage of off gas out of the retort into surrounding spaces is prevented.

According to another version of this invention, the gas withdrawing means 36 connected to the outlet from the retort has sufficient capacity for reducing pressure in the retort enough to cause air to flow from the atmosphere into the retort through the inlet conduits 30, 32, without need for the blower 34. In this version, the entire retort is maintained at subatmospheric pressure.

Although this invention has been described in considerable detail with reference to certain versions thereof, other versions of the invention are now within the skill of the art. For example, although the drawing shows a retort where the combustion and retorting zones are advancing downwardly through the retort, this invention is also useful for retorts where the combustion and retorting zones are advancing upwardly or transverse to the vertical. Because of variations such as this, the spirit and scope of the appended claims should not necessarily be limited to the description of the preferred versions of the invention.

What is claimed is:

1. In an in situ oil shale retort for recovering carbonaceous materials from oil shale wherein a subterranean cavity is formed above an access tunnel in a formation containing oil shale, the cavity containing a fragmented permeable mass of formation particles substantially filling the cavity, apparatus comprising gas pumping means having an input and output, means connecting the input of the gas pumping means to the bottom region of the retort cavity through the access tunnel for pumping gas from the cavity, and means for blocking the tunnel adjacent the cavity, the improvement comprising the gas pumping means having sufficient capacity for reducing the gas pressure within the bottom region of the cavity to a pressure below the pressure in the access tunnel to prevent leakage from the cavity into the access tunnel.

2. In the apparatus of claim 1, the further improvement comprising inlet means connecting the upper portion of the cavity to the atmosphere such that the pressure in the cavity will cause air to flow from the atmosphere into the upper region of the cavity through said inlet means.

3. In the apparatus of claim 1, the further improvement comprising inlet means connecting the upper portion of the cavity to the atmosphere and blower means for forcing air into said inlet means with sufficient pressure to balance the pressure drop through the inlet means while maintaining the bottom of the cavity at subatmospheric pressure.

4. In a process for retorting oil shale in situ wherein a subterranean cavity is formed in a formation containing oil shale, the formation contains underground workings, the cavity contains a fragmented permeable mass of formation particles containing oil shale and the particles containing oil shale in the cavity are burned and produce product gases wherein the improvement comprises pumping gases from the bottom of the cavity at a rate sufficient to reduce the pressure within all parts of the cavity to a pressure below the ambient pressure within underground workings adjacent the cavity for preventing leakage of product gases from the cavity into such underground workings.

5. In a process for retorting oil shale in situ by forming a subterranean cavity in a formation containing oil shale, the cavity containing a fragmented permeable mass of formation particles containing oil shale and burning the oil shale particles in an upper region of the cavity and producing product gases, an improved method of preventing leakage of product gases comprising pumping gases from the bottom of the cavity at a rate sufficient to reduce the pressure within all parts of the cavity to subambient levels, and pumping fresh air into the upper region of the cavity in combination with pumping out of the product gases at a rate sufficient to maintain the pressure at the top of the cavity at or slightly below ambient pressure.

6. In a process for retorting oil shale in situ wherein a subterranean cavity containing particles of oil shale is formed in an oil shale deposit adjacent at least one tunnel in the deposit and carbonaceous material in the oil shale is burned and produces product gases, wherein the improvement in the process is for preventing leakage of product gases into such an adjacent tunnel and comprises the step of pumping product gases from the cavity at a rate sufficient to reduce the pressure in the cavity adjacent to such tunnel to a pressure below the ambient pressure within such tunnel.

7. A process as recited in claim 6 wherein the tunnel is adjacent the bottom of the cavity and the pumping step comprises pumping product gases from the bottom of the cavity.

8. A process as recited in claim 7 wherein the pumping is at a sufficient rate to reduce the pressure within all parts of the cavity to less than ambient pressure in such a tunnel.

9. A process as recited in claim 7 wherein the top of the cavity is in fluid communication with the atmosphere and the pumping is at a sufficient rate to cause air to flow from the atmosphere into the top of the cavity.

10. In an in situ oil shale retort in a subterranean formation containing oil shale for retorting carbonaceous materials from oil shale wherein the retort is formed adjacent at least one tunnel in the formation, the retort containing a fragmented permeable mass of formation particles containing oil shale, wherein the improvement comprises gas withdrawing means connected to the retort for withdrawing gas from the retort, the withdrawing means having sufficient capacity for reducing the gas pressure within at least a portion of the retort adjacent such a tunnel to a pressure less than the pressure in the tunnel to prevent leakage of gas from the retort into the tunnel.

11. The apparatus of claim 10 further including inlet means for communicating with the retort remote from the gas withdrawing means for introducing an inlet gas into the retort.

12. The apparatus of claim 11 in which the withdrawing means has sufficient capacity for reducing pressure in the retort enough to cause air to flow from the atmosphere into the retort through said inlet means.

13. The apparatus of claim 11 further including blower means connected to the inlet means for introducing gas into said inlet means.

14. In a process for retorting oil shale in an situ oil shale retort in a subterranean formation containing oil shale, the retort containing a fragmented permeable mass of formation particles containing oil shale, comprising igniting a portion of the fragmented mass for establishing a combustion zone therein, introducing an oxygen supplying gas at a gas inlet to the fragmented mass on a trailing side of the combustion zone for sustaining the combustion zone and advancing the combustion zone through the fragmented mass, whereby a retorting zone is sustained and advanced through the fragmented mass on the advancing side of the combustion zone for producing liquid and gaseous products, and withdrawing off gas containing the gaseous products from the fragmented mass on the advancing side of the retorting zone, said formation having at least one tunnel adjacent the retort, the improvement comprising a method of preventing leakage of gas from the in situ oil shale retort to such a tunnel by withdrawing off gas from the fragmented mass on the advancing side of the retorting zone at a rate sufficient to reduce pressure within the in situ oil shale retort on the advancing side of the combustion zone to less than the ambient pressure in such a tunnel.

15. In a process as recited in claim 14 wherein off gas is withdrawn from the retort at a rate sufficient to reduce the pressure in all parts of the retort to less than the ambient pressure in such a tunnel adjacent the retort.

16. In a process as recited in claim 14, the further improvement comprising the step of introducing air into the retort while withdrawing off gas at a rate sufficient to maintain pressure at the gas inlet to the retort at or slightly below the ambient pressure in such a tunnel adjacent the retort.

* * * * *

Disclaimer 4,076,312.—*Chang Yul Cha,* Bakersfield, Calif.; *Richard D. Ridley* and *Robert S. Burton, III,* Grand Junction, Colo. METHOD AND APPARATUS FOR RETORTING OIL SHALE AT SUBATMOSPHERIC PRESSURE. Patent dated Feb. 28, 1978. Disclaimer filed Aug. 31, 1981, by the assignee, *Occidental Oil Shale, Inc.*

Hereby enters this disclaimer to all claims of said patent.

[*Official Gazette June 15, 1982.*]